US006501254B2

(12) United States Patent
Spalding, Jr.

(10) Patent No.: US 6,501,254 B2
(45) Date of Patent: Dec. 31, 2002

(54) VOLTAGE SOURCE

(75) Inventor: George R. Spalding, Jr., Limerick (IE)

(73) Assignee: Analog Devices, Inc., Norwood, MA (US)

( * ) Notice: Subject to any disclaimer, the term of this patent is extended or adjusted under 35 U.S.C. 154(b) by 0 days.

(21) Appl. No.: 09/939,820

(22) Filed: Aug. 27, 2001

(65) Prior Publication Data

US 2002/0043965 A1 Apr. 18, 2002

(51) Int. Cl.[7] ..... G05F 3/08
(52) U.S. Cl. ..... 323/312; 323/315
(58) Field of Search ..... 323/282, 285, 323/312, 313, 315

(56) References Cited

U.S. PATENT DOCUMENTS 4,912,393 A * 3/1990 Anderson et al. ..... 323/313
5,955,915 A * 9/1999 Edwards ..... 327/541
6,150,872 A * 11/2000 McNeill et al. ..... 327/539
6,188,212 B1 * 2/2001 Larson et al. ..... 323/281

* cited by examiner

*Primary Examiner*—Adolf Deneke Berhane
(74) *Attorney, Agent, or Firm*—Wolf, Greenfield & Sacks, P.C.

(57) ABSTRACT

A voltage source circuit adapted to provide a regulated output voltage independent of variations in an input voltage and having an input node adapted to receive an input reference current and an output node adapted to provide a definable voltage output. The circuit comprises a control element adapted to provide an output signal to the output node, an impedance being driven by the output signal of the control element, and a sensing element having a current mirror adapted to sense the current flowing through the impedance, and to provide a feedback signal. The control element is responsive to the difference between the feedback signal and the input reference current, thereby providing a regulated voltage output.

23 Claims, 5 Drawing Sheets

VOLTAGE SOURCE

FIELD OF THE INVENTION

The invention relates to electronic circuits and particularly to an electronic circuit adapted for use as a voltage source, and more particularly to voltage sources adapted to provide a regulated voltage.

BACKGROUND TO THE INVENTION

The provision of a well controlled voltage at a low impedance and independent of supply voltage changes is important in many applications, especially high speed mixed signal Integrated Circuit (IC) designs. Although regulation usually implies a circuit that is immune to changes in the load impedance and current, there are applications where the load is well defined and behaved, one such example being biasing.

Standard regulators usually suffer from the problems of either poor power supply rejection, poor stability characteristics or high drop out, which means that the input and output voltages of the regulator cannot be close. Problems associated with prior art implementations arise in situations where it is required to implement the voltage source in circuits having low headroom as many of the prior art solutions utilize replicator type circuit incorporating current sources to provide the constant regulated voltage.

FIG. 1 shows a simple voltage source circuit 100 according to the prior art adapted to regulate the output voltage on detection of variations to an input voltage. A voltage input 105 which is usually the supply to the circuit is connected to the source 110 of a transistor 115 whose gate potential 120 is controlled by the output of an amplifier 125. The drain 130 of the transistor 115 is connected to an output voltage node 130, which maintains the voltage utilizing an resistor impedance 135. A first input 140 of the amplifier 125 is used to sense the output voltage and a second input 145 is a reference voltage input. The sensed output voltage is fed back to the amplifier and compared with the reference voltage, thereby controlling the gate voltage and maintaining a constant voltage output at a voltage node 130.

FIG. 2 illustrates an alternative prior art voltage source configuration 200 which uses a top current mirror (MN1, MN2) to ensure that the currents in Q1 and Q2 are equal (or directly proportional). If this is true, it can be readily shown that:

$$I1=(Vt/R2)*\ln(A) \qquad \text{(equation 1)}$$

where A is the ratio of the sizes of Q1 and Q2, Vt is the thermal voltage of a bipolar transistor and R2 is the value of the resistor R2. If equation 1 is satisfied it will be appreciated that the output voltage is independent of the input voltage $V_i$, being only a function of I1 and the parameters of R1 and Q1. This circuit suffers, however, in that when a load current is place on the output voltage positive feedback is employed, which magnifies the errors due to load current. In this case, the load current subtracts current from the impedance, and the current which is fed back (via the top mirror) decreases, thus supplying LESS current to the output.

Arising from the above mentioned shortcomings of the prior art techniques there is a need for a voltage source that is simple and easy to implement, can be used to achieve an output that is both independent of the input and has a low output impedance, utilizing real impedances independent of the gain of the circuit, is operable in circumstances having a load current applied to the voltage output and minimizes headroom requirements.

SUMMARY OF THE INVENTION

These needs and others are satisfied by the present invention. In accordance with one aspect of the present invention a regulated voltage source circuit is provided, the voltage source adapted to provide a regulated output voltage independent of variations in an input voltage and having an input node adapted to receive an input reference current and an output node adapted to provide a definable voltage output, the circuit comprising:

- a control element adapted to provide an output signal to the output node,
- an impedance being driven by the output signal of the control element,
- a sensing element having a current mirror adapted to sense the current flowing through the impedance, and to provide a feedback signal, and wherein the control element is responsive to the difference between the feedback signal and the input reference current.

The feedback signal is desirably a negative feedback signal, such that when a load current is applied to the output voltage node, the sensed current flowing through the impedance drops and the control element increases the output signal to the output node. By employing a negative feedback response within the voltage regulator the error in the output voltage response due to applied load at that node is reduced.

The circuit may additionally include a current inversion element provided between the sensing element and the control element, the current inversion element adapted to invert the signal from the sensing element prior to driving the control element in order to achieve the negative feedback.

The current inversion element may desirably include a current mirror having a matching pair of transistors.

The sensing element may comprise one or more pairs of matching transistors forming the current mirror, the input of the current mirror being connected to the impedance.

The current mirror is desirably adapted to sense the current through the impedance and also contributes to that impedance.

The control element may include a current mirror, comprising at least one matching transistor pair.

The transistors are preferably selected from MOSFET or bipolar transistors.

The impedance may include a diode, a diode/resistor combination or equivalents.

The sensing element and impedance may be integrally formed.

The invention additionally comprises a voltage source circuit having an input reference current and providing an output voltage, the circuit comprising at least one impedance component in electronic communication with a control current source having an input and an output, the output driving the impedance components and the output of the voltage source. Sensing elements adapted to sense the current flow through the impedance components are additionally provided together with comparison elements adapted to compare the sensed current with respect to the reference current source. The comparison elements are adapted on detection of any variance between the sensed current and the reference current to vary the input to the input of the control current source thereby varying the current flow through the impedance and maintaining a regulated voltage output.

In one form of the invention the sensing elements comprise at least one current mirror, and the current mirror may form a portion of the impedance components.

Desirably the impedance components are temperature dependant such that the impedance of the components varies with temperature. Typically the components are selected from one or more of the following electronic components: diodes, bipolar transistors, MOS transistors, and/or resistors.

In a preferred embodiment the control current source is adapted to provide a variable signal. Any variations between the sensed current and the reference current can then be used to vary the output of the control current source so as to compensate for this variance.

The sensing elements are desirably further adapted to sense any voltage drop at the output of the voltage source due to a load there, which equivalently to the sensing of any variance between the reference current and the sensed current can be used to vary the current applied to the impedance so as to compensate for this voltage drop.

The comparison means desirably includes a current mirror whose output is compared to the input reference current.

The reference current may be Proportional to Absolute Temperature (PTAT), and it will be appreciated by those skilled in the art that by including components within the impedance element which are also temperature dependant that the circuit of the present invention can be made to have any desired temperature dependence, or be independent of temperature.

In a first embodiment the output of the voltage source is ground referred, i.e. current source is between the impedance and the input to the voltage source; alternatively the output of the voltage source is supplied referred: i.e. current source is between the impedance and ground; or alternatively the output of the voltage source is floating.

Further objects, features and advantages of the present invention will become apparent from the following description and drawings.

DETAILED DESCRIPTION OF THE DRAWINGS

Figure 1:
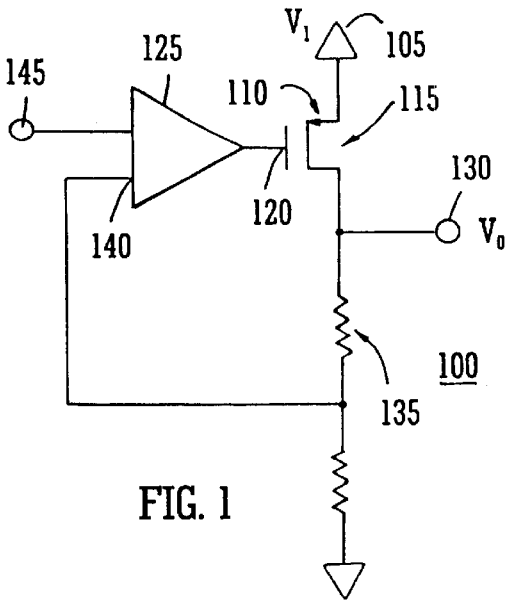
FIG. 1 shows a simple voltage source according to the prior art.
Figure 2:
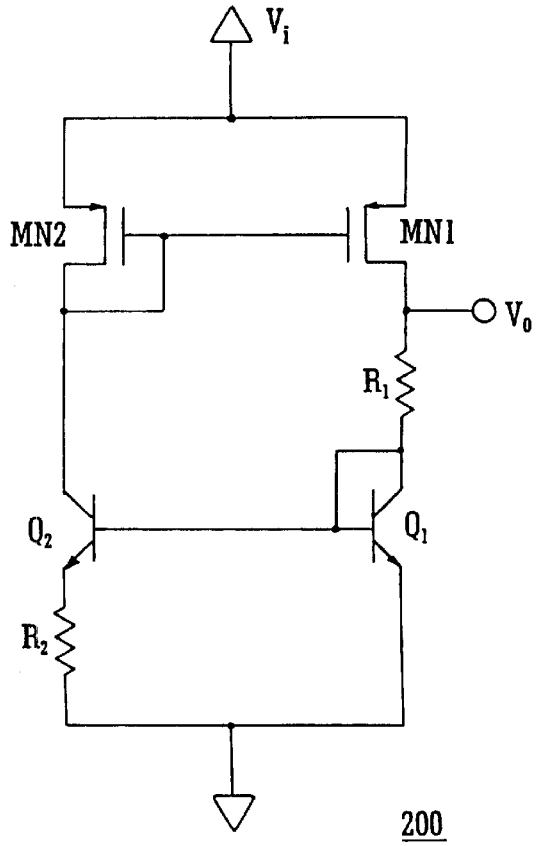
FIG. 2 shows an alternative voltage source according to the prior art.

FIGS. 1 and 2 have been previously described with reference to the prior art.

Figure 3:
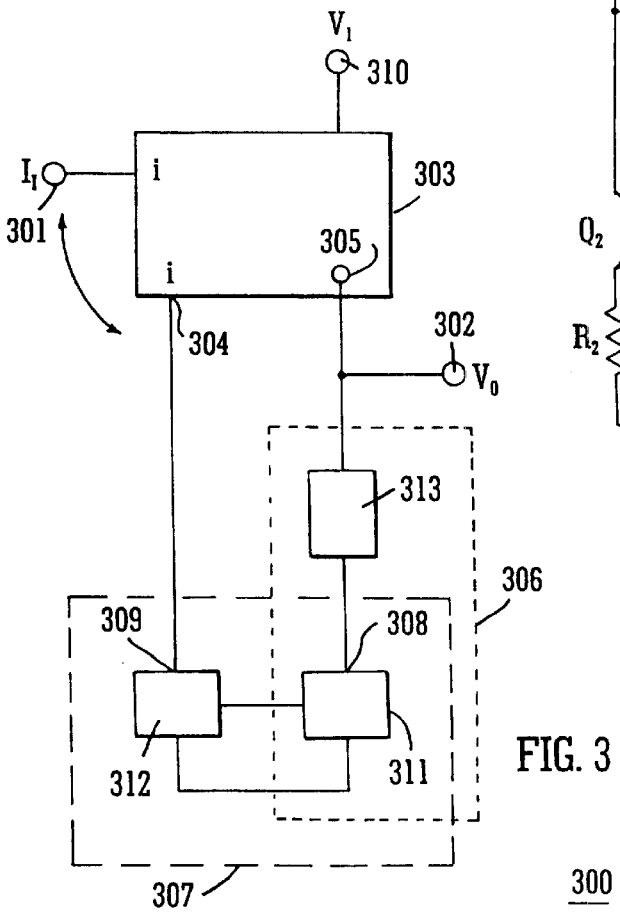
FIG. 3 shows a voltage source circuit according to the present invention.

FIG. 3 shows in functional blocks a voltage source 300 or regulator according to the present invention that is adapted to provide a constant voltage output independent of variances to an input voltage 310 to the circuit. The circuit 300 is provided having an input node 301 adapted to receive an input reference current and an output node 302 adapted to provide a definable voltage output. The circuit includes a control element 303 having an input 304 and an output 305, the output adapted to provide an output signal to the output node 302.

The control element is also provided with inputs from both the reference current 301 and the input voltage 310. An impedance 306 driven by the output signal of the control element is also provided. A sensing element 307 including a first current mirror comprises two matching devices 312, 313 with the output signal provided at device 312 being related to that input at device 311, and having an input 308 adapted to sense the current flowing through the impedance 306, so as to provide a feedback signal at an output 309 is also provided.

The impedance 306 of the output is determined by the series impedance of the mirror 312, 313, an impedance element 313, and the loop gain. It will be appreciated that the power supply rejection is determined by the output impedance of the current mirrors of both the control element and the sensing element. The impedance element may include both a resistive load 313 and a component from the sensing element 307 such as the first device 311, or the impedance provided by the mirror may not necessitate the provision of additional impedances.

Figure 4:
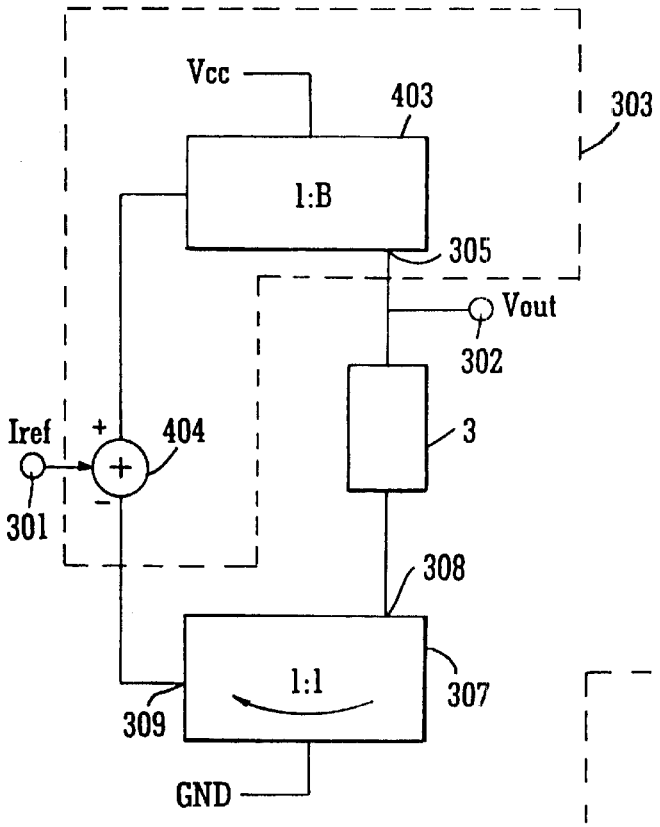
FIG. 4 is an exemplary embodiment of the circuit of FIG. 3.

The control element 303 is responsive to the difference between the feedback signal and the input reference current 301, and varies its output to the impedance in response to any detected variance. As shown in FIG. 4, the control 303 element typically includes a current mirror 403 and a summation element 404. The same reference numerals are used for equivalent components. It will be appreciated that the output voltage 302 is determined by the series combination of the lower mirror 307 input current/voltage characteristic, the impedance as measured across the impedance element 306, and the fraction of the current from the top mirror 403 that does not flow into the load impedance 306. The rest of the circuitry is a servo loop that compares the current in the lower mirror 307 with the reference 301, and uses the gained up result to provide the output current and voltage.

The feedback signal provided by the sensing element to the control element is desirably a negative feedback signal. When a load current is applied to the output voltage node, the sensed current flowing through the impedance drops and the control element increases the output signal to the output node. By employing a negative feedback response within the voltage regulator the errors in the output voltage response due to applied load at that node is reduced.

Figure 5:
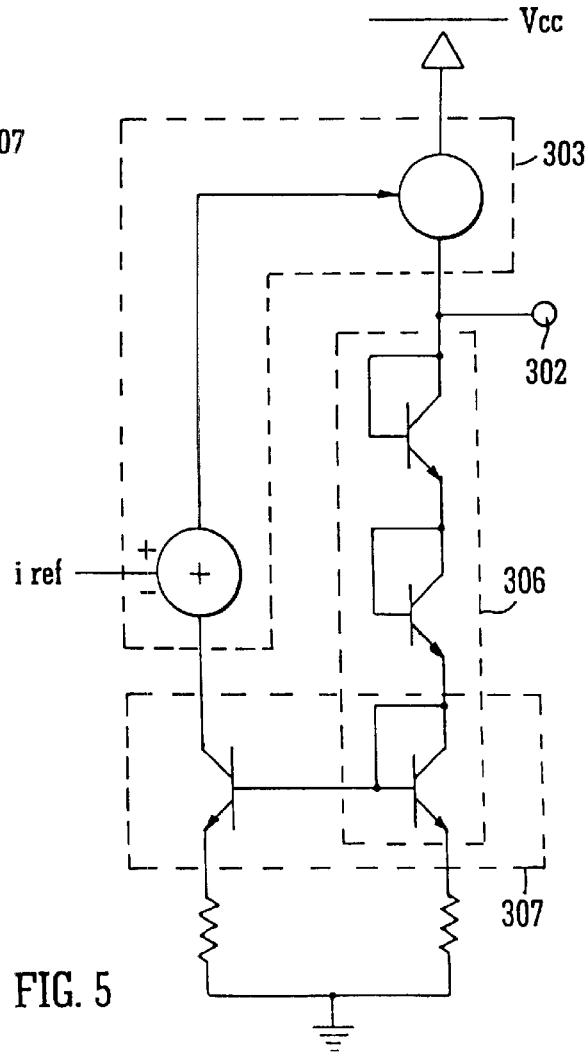
FIG. 5 shows possible configurations for the components of FIGS. 3 and 4.

FIG. 5 shows an exemplary embodiment of the circuit of the voltage source described in FIGS. 3 and 4. The components comprising the blocks detailed in FIG. 3 are shown in dashed outline. It will be apparent to those skilled in the art that the control element 303 comprising a control current source is sensitive to any error in the current between the reference current I ref and the sensed current, as sensed by the sensing element.

Figure 6:
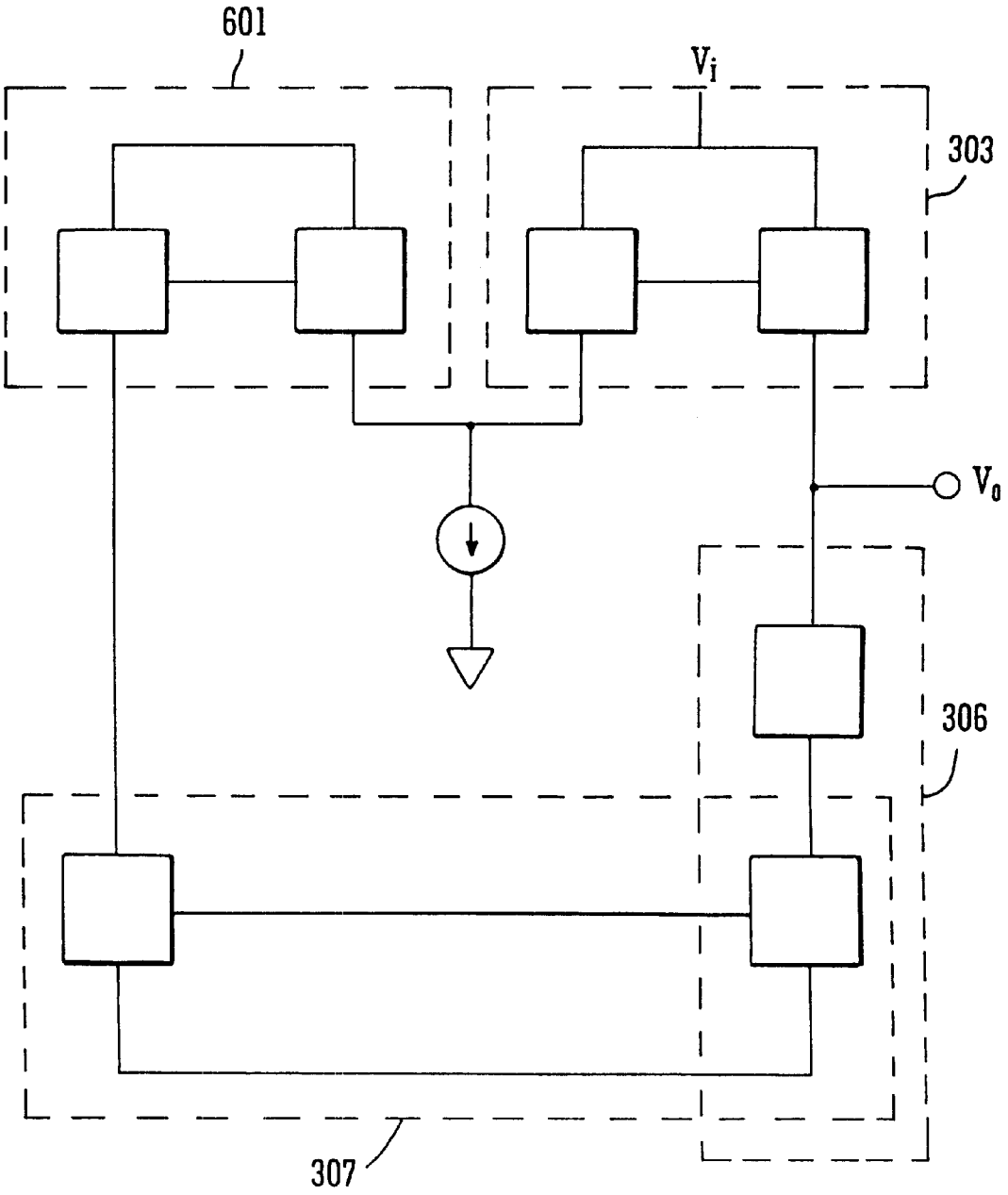
FIG. 6 shows the provision of a current inversion element within the circuit of the present invention.

FIG. 6 shows in block format a modification to the circuit hereinbefore described detailing the provision of a current inversion element 601 comprising a current mirror having two matching devices 602, 603. The components making up the elements previously described are highlighted with dashed lines and it is apparent that the current inversion element is provided between the control element 303 and the sensing element 307.

Figure 7:
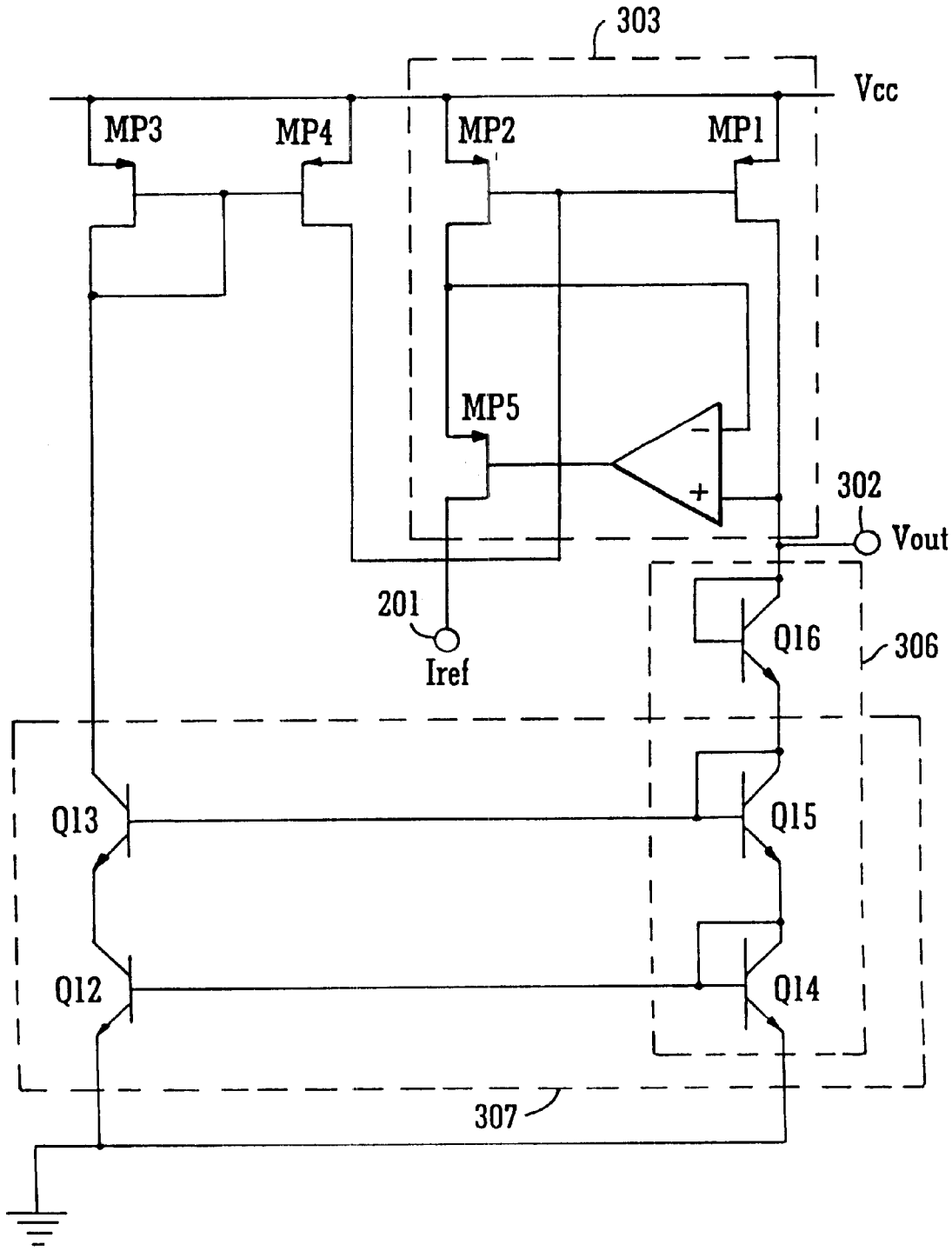
FIG. 7 shows possible configurations for the block components shown in FIG. 6.

FIG. 7 shows in detail examples of devices that may be used to functionally complete the block components shown in FIG. 6. It will be appreciated that these are exemplary devices and it is not intended to limit the invention to the components thus described. As will be appreciated this circuit works well when the load current is known and can be matched by the reference current. The output impedance 306 is the impedance raised by the three diode stack (Q14, Q15, Q16). By setting the diode stack current to a fixed ratio of the output current, the output mirror (MP1, MP2) can be sized so that the current density of all devices is matched, thus minimizing offsets. The power supply rejection is determined by the output impedance of the current mirrors with respect to the impedance of the diode stack. In FIG. 7, the third current mirror (MP3, MP4) provides the current inversion needed for the subtraction of the reference and feedback currents. It will be appreciated that the choice of components for the impedance block can be used for effecting changes to the output characteristics of the circuit.

Figure 8:
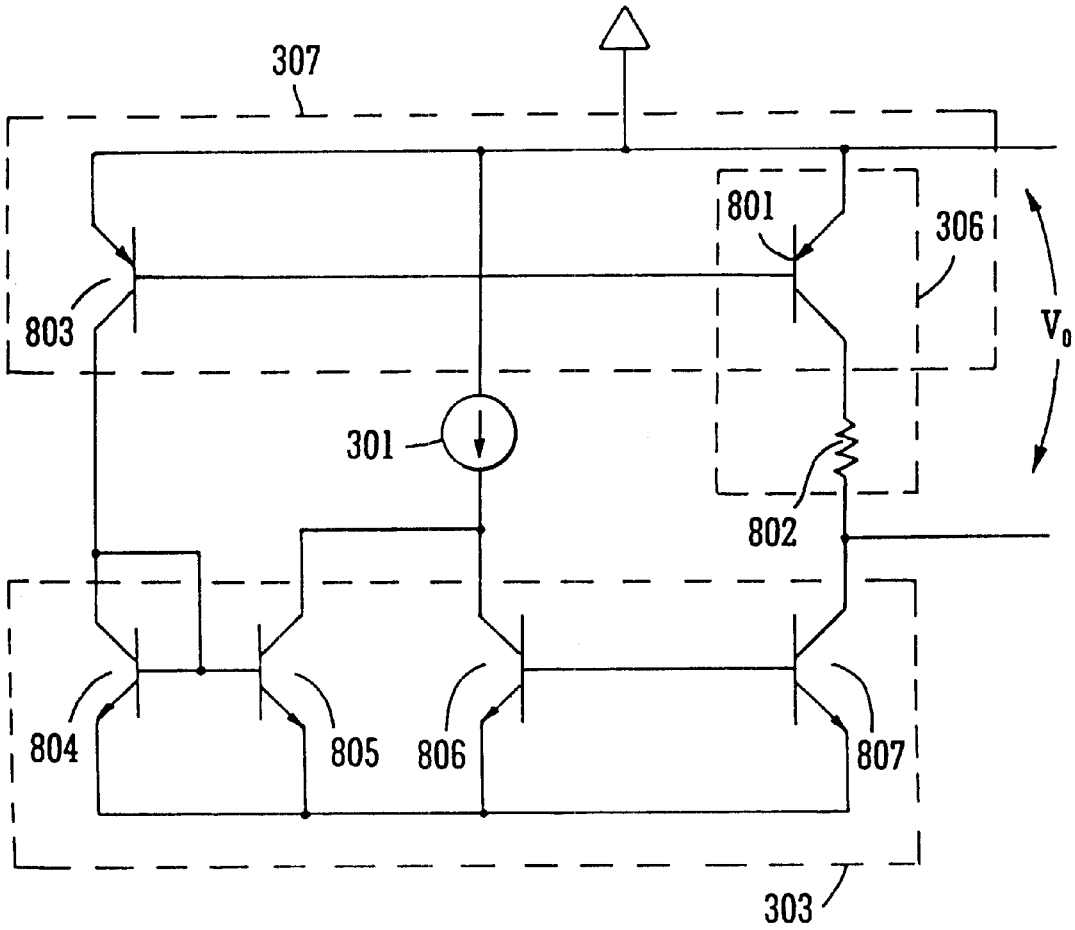
FIG. 8 shows an alternative embodiment to the circuit illustrated in FIG. 3.

FIG. 8 shows an alternative embodiment of the invention to that of FIG. 3, inverted and which incorporates a voltage drop which is constant with varying temperature. Again those components representing the blocks in FIG. 3 are shown in dashed outline. The impedance 306 comprises a first transistor 801, configured as a diode, together with a resistor 802. A second transistor 803 acts to mirror the current sensed at the impedance and then drives a second current mirror, having two transistors 804, 805. The output of this second current mirror is summed with the reference input current 301, and used to drive a third current mirror (transistors 806, 807). It will be appreciated that if the reference current 301 is proportional to temperature that with proper scaling of the resistor 302, that the output voltage can be made constant with temperature.

It will be appreciated by those skilled in the art that the voltage source circuit of the present invention has advantages over the prior art including the fact that the gain of the circuit can be kept low so as to make compensation easier. If load current is poorly controlled which, as will be appreciated by those skilled in the art may arise from differing applications of the circuit, the gain of the loop can be increased to compensate. The circuit of the present invention provides good PSRR-, and it will be appreciated that as the PSRR and output impedance are set by real impedances (diodes & resistors) there is little or no reliance on gain to effect the impedance of the circuit. Although it has not been illustrated with reference to the above drawings it will be appreciated by those skilled in the art that the circuit can be compensated (and the PSRR improved) by incorporation of devices such as a load cap to ground. It will be appreciated that the specific embodiments herein described may be modified without departing from the spirit and scope of the present invention to be supply/ground or floating referred.

There has been described herein a voltage source having improved performance that offers distinct advantages over the prior art. It will be apparent to those skilled in the art that various modifications can be made without departing from the spirit and the scope of the invention. Accordingly it is not intended to limit the invention except as may be necessary in view of the appended claims.

The words "comprises/comprising" and the words "having/including" when used herein with reference to the present invention are used to specify the presence of stated features, integers, steps or components but does not preclude the presence or addition of one or more other features, integers, steps, components or groups thereof.

What is claimed is:

1. A voltage source circuit adapted to provide a regulated output voltage independent of variations in an input voltage and having an input node adapted to receive an input reference current and an output node adapted to provide a definable voltage output, the circuit comprising:

a) a control element adapted to provide an output signal to the output node, b) an impedance being driven by the output signal of the control element, c) a sensing element having a current mirror adapted to sense the current flowing through the impedance, and to provide a feedback signal, and wherein the control element is responsive to the difference between the feedback signal and the input reference current.

2. The circuit as claimed in claim 1 wherein the feedback signal is a negative feedback signal, such that when a load current is applied to the output voltage node, the sensed current flowing through the impedance drops and the control element increases the output signal to the output node.

3. The circuit as claimed in claim 2 additionally including a current inversion element provided between the sensing element and the control element, the current inversion element adapted to invert the signal from the sensing element prior to driving the control element so as to effect the provision of the negative feedback.

4. The circuit as claimed in claim 3 wherein the current inversion element includes a current mirror having a matching pair of transistors.

5. The circuit as claimed in claim 1 wherein the sensing element comprises one or more pairs of matching transistors forming the current mirror, the input of the current mirror being connected to the impedance and forming part of the impedance.

6. The circuit as claimed in claim 5 wherein the control element includes a current mirror having one or more pairs of matching transistors.

7. The circuit as claimed in claim 6 wherein the transistors are MOSFET transistors.

8. The circuit as claimed in claim 1 wherein the impedance may include a diode, a diode/resistor combination or equivalents.

9. The circuit as claimed in claim 1 wherein the sensing element and impedance are integrally formed.

10. A voltage source circuit having an input reference current, an input voltage and providing an output voltage, the circuit comprising:

a) at least one impedance component in electronic communication with a controlled current source having two inputs, and an output, the output driving the impedance components and the output of the voltage source, b) sensing elements including a current mirror and adapted to sense the current flow through the impedance components, c) comparison elements adapted to compare the sensed current with respect to the reference current source, and wherein the a first input of the current source is connected to the comparison elements and the second input is connected to the input voltage and the comparison element outputs a negative feedback signal to the controlled current source such that any load applied to the output voltage effects an incremental change in the input of the controlled current source thereby maintaining a regulated voltage output.

11. The circuit as claimed in claim 10 wherein the comparison element includes a current mirror.

12. The circuit as claimed in claim 10 wherein a portion of the current mirror of the sensing element forms a portion of the impedance components.

13. The circuit as claimed in claim 10 wherein the impedance components are temperature dependant such that the impedance of the components varies with temperature.

14. The circuit as claimed in claim 10 wherein the components are selected from one or more of the following electronic components: diodes, bipolar transistors, MOS transistors, and/or resistors.

15. The circuit as claimed in claim 10 wherein the control current source is adapted to provide a variable signal and any variations between the sensed current and the reference current are used to vary the output of the control current source so as to compensate for this variance.

16. The circuit as claimed in claim 10 wherein the sensing elements are further adapted to sense any voltage drop at the output of the voltage source due to a load there, which equivalently to the sensing of any variance between the reference current and the sensed current can be used to vary the current applied to the impedance so as to compensate for this voltage drop.

17. The circuit as claimed in claim 10 wherein the sensing element includes the impedance component.

18. The circuit as claimed in claim 10 wherein the comparison means includes a current mirror whose output is compared to the input reference current.

19. The circuit as claimed in claim 10 wherein the reference current is temperature dependant and the circuit includes components within the impedance element which are also temperature dependant thereby compensating for temperature dependant fluctuations.

20. A voltage source adapted to provide a regulated output voltage independent of variations in an input voltage and having an input node adapted to receive an input reference current and an output node adapted to provide a definable voltage output, the circuit comprising:

a) a control element having a current mirror and adapted to provide an output signal to the output node, b) an impedance being driven by the output signal of the control element, c) a sensing element having a current mirror adapted to sense the current flowing through the impedance, and to provide a feedback signal, d) a current inversion element provided between the sensing element and the control element, and wherein the current inversion element provides a negative feedback signal to the control element, the control element being responsive to the difference between the feedback signal and the input reference current, such that when a load current is applied to the output voltage node, the sensed current flowing through the impedance drops and the control element increases the output signal to the output node.

21. The circuit as claimed in claim 20 wherein the current mirrors are provided by matching transistor pairs.

22. The circuit as claimed in claim 21 wherein the transistors are MOS FET transistors.

23. A method of providing a regulated voltage output at an output of node of a voltage source circuit, the circuit having an input voltage, an input reference current, the method comprising the steps of:

a) providing control means adapted to provide an output signal to the output node, b) providing an impedance being driven by the output signal of the control element, c) providing a sensing element having a current mirror adapted to sense the current flowing through the impedance, and to provide a feedback signal, and wherein the control element is responsive to the difference between the feedback signal and the input reference current.

* * * * *